US009304415B2

(12) United States Patent
Lee et al.

(10) Patent No.: US 9,304,415 B2
(45) Date of Patent: Apr. 5, 2016

(54) COATING LIQUID DISPENSERS

(71) Applicant: HEWLETT-PACKARD DEVELOPMENT COMPANY, L.P., Houston, TX (US)

(72) Inventors: Michael H. Lee, Palo Alto, CA (US); Krzysztof Nauka, Palo Alto, CA (US); Henryk Birecki, Palo Alto, CA (US); Napoleon J. Leoni, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 42 days.

(21) Appl. No.: 13/871,701

(22) Filed: Apr. 26, 2013

(65) Prior Publication Data

US 2014/0318447 A1 Oct. 30, 2014

(51) Int. Cl.

| | |
|---|---|
| ***B05B 7/06*** | (2006.01) |
| ***B05C 1/06*** | (2006.01) |
| ***G03G 5/05*** | (2006.01) |
| ***B05B 15/08*** | (2006.01) |
| ***B05C 5/02*** | (2006.01) |

(52) U.S. Cl.

CPC ..... *G03G 5/0525* (2013.01); *B05B 15/08* (2013.01); *B05C 5/0275* (2013.01); *Y10T 29/494* (2015.01)

(58) Field of Classification Search

CPC ..... B05C 5/0275
USPC ..... 118/261, 413, 33, 67, 68, 123, 304, 118/313–315, 663, 692
See application file for complete search history.

(56) References Cited

U.S. PATENT DOCUMENTS

| | | | | |
|---|---|---|---|---|
| 4,527,507 | A * | 7/1985 | Sawai et al. | 118/314 |
| 5,101,760 | A * | 4/1992 | Sollinger | 118/410 |
| 6,312,523 | B1 * | 11/2001 | Caldwell et al. | 118/663 |
| 7,094,292 | B2 * | 8/2006 | Randall et al. | 118/679 |
| 2002/0121239 | A1 * | 9/2002 | Tonazzi et al. | 118/401 |
| 2005/0188920 | A1 * | 9/2005 | Shimoda | 118/663 |

(Continued)

FOREIGN PATENT DOCUMENTS

| | | |
|---|---|---|
| JP | 2008253908 | 10/2008 |
| WO | 9118682 | 12/1991 |
| WO | 2011159276 | 12/2011 |

OTHER PUBLICATIONS

Assad et al., Spray-Coating Route for Highly Aligned and Large-Scale Arrays of Nanowires, ACS NANO, vol. 6, No. 6, 2012, pp. 4702-4712.
Nordson, Performus III & IV Dispensers, 2010, 2 pages.

(Continued)

*Primary Examiner* — Yewebdar Tadesse
(74) *Attorney, Agent, or Firm* — Dicke, Billig & Czaja, PLLC

(57) ABSTRACT

A coating system includes a leveling element and a dispenser assembly. The leveling element extends generally transverse to a substrate advance orientation and is releasably engageable against a substrate support. The dispenser assembly includes an array of side-by-side independent liquid dispensers and an air pressure assembly to supply a common air pressure to each dispenser to cause pressurized dispensing of a coating liquid from each dispenser onto a substrate on the substrate support. The liquid dispensing occurs at least during relative movement between the dispenser assembly and the substrate support and during the relative movement, the leveling element is actuated to uniformize the coating liquid on the substrate.

14 Claims, 5 Drawing Sheets

(56) References Cited

U.S. PATENT DOCUMENTS

2006/0188645 A1* 8/2006 Forti et al. ..... 427/8
2006/0292295 A1 12/2006 Kwon et al.

OTHER PUBLICATIONS

Cheminstruments, EF-100/200 Fixed & Variable Speed Drawdown, http://www.chemsultants.com/testing-equipment-products/, Apr. 26, 2013, 2 pages.

* cited by examiner

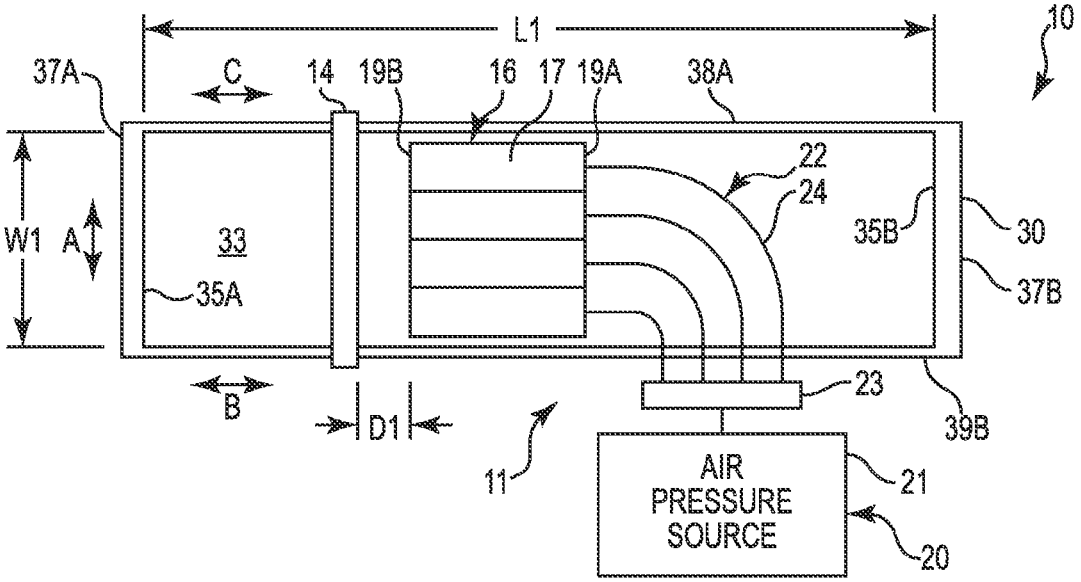
Fig. 1A
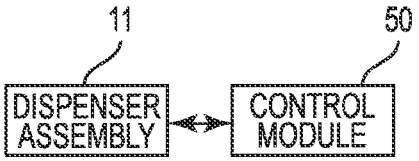
Fig. 1B
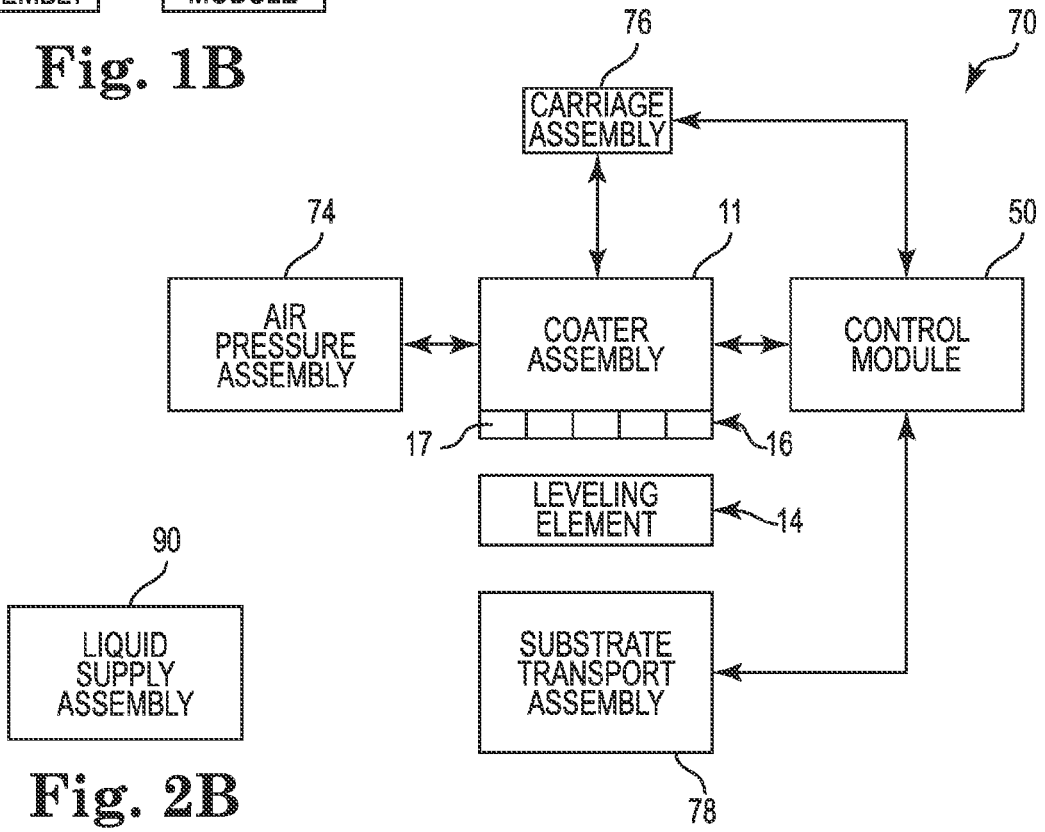
Fig. 2B
Fig. 2A

COATING LIQUID DISPENSERS

BACKGROUND

Surface coating is found in a variety of different fields. For example, coating of a surface of an article may be used to improve the appearance and/or longevity of the article. A wide variety of coating devices exist with their features depending on the type of article to be coated and/or the type of coating to be applied.

BRIEF DESCRIPTION OF THE DRAWINGS

FIG. 1A is a diagram schematically illustrating a coating system, according to one example of the present disclosure.

FIG. 1B is a block diagram schematically illustrating a coating system, according to one example of the present disclosure.

FIG. 2A is a block diagram schematically illustrating a coating system, according to one example of the present disclosure.

FIG. 2B is a block diagram schematically illustrating a liquid supply assembly, according to one example of the present disclosure.

DETAILED DESCRIPTION

Figure 3A:
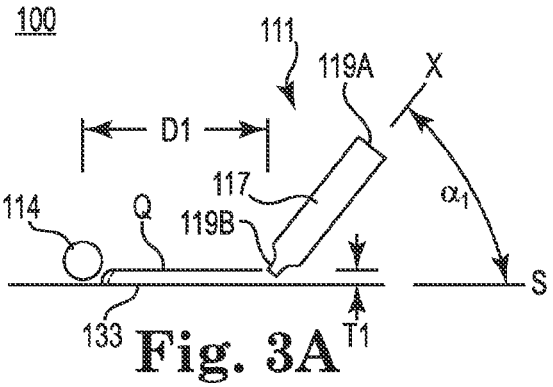
FIG. 3A is a diagram including a side view schematically illustrating a dispenser assembly in a dispensing mode, according to one example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense.

At least some examples of the present disclosure provide systems and assemblies for applying a generally uniform coating onto a substrate.

In at least some examples of the present disclosure, a coating system comprises a leveling element and a dispenser assembly. The leveling element extends generally transverse to a substrate advance orientation and is releasably engageable relative to a substrate support. The dispenser assembly includes an array of side-by-side independent liquid dispensers and an air pressure assembly. The air pressure assembly supplies a common air pressure to each dispenser to cause pressurized dispensing of a coating liquid from each dispenser onto a substrate on the substrate support. In one aspect, the liquid dispensing occurs at least during relative movement between the dispenser assembly and the substrate support. In another aspect, during the relative movement, the leveling element is actuated to uniformize the coating liquid on the substrate and achieve a target thickness.

In some examples, the coating liquid is dispensed via a low viscosity carrier and the finished coating is a coating having a thickness on the order of 100 nanometers.

In at least some examples of the present disclosure, a coating system provides a cost-effective arrangement to apply a liquid coating onto a substrate using individual dispensing units, which can be disposable. In one aspect, by using independent liquid dispensers arranged side-by-side in an array, at least some examples of the present disclosure enable omitting a traditional central manifold that distributes liquid to each dispensing unit. Accordingly, at least some examples of the present disclosure achieve a much lighter and less complex construction than traditional coating systems.

In at least some examples of the present disclosure, the coating system permits varying the volume of coating applied across the array of dispensing units. By doing so, greater amounts of coating liquid can be applied from a central region of the dispenser assembly and lesser amounts of coating liquid are applied at the outer regions. This arrangement reduces overcoating waste at the outer edges of the substrate while still achieving a generally uniform coating across an entire width of the substrate.

In at least some examples of the present disclosure, the angle at which the liquid dispensers direct the coating liquid onto the substrate can be varied. In some examples, the angle of the dispenser assembly can be switched between a dispensing mode having a relatively steep angle for applying coatings and an idle mode having a relatively shallow or flat angle for preventing dripping while in a non-dispensing state.

Via these arrangements and other aspects, at least some examples of the present disclosure provide for a highly effective, low-cost coating system that can be used to apply a wide variety of coating materials onto a substrate.

These examples, and additional examples, of the present disclosure are described and illustrated in association with FIGS. 1A-11.

FIG. 1A is a block diagram schematically illustrating a coating system 10, according to one example of the present disclosure. As shown in FIG. 1A, the coating system 10 includes a dispenser assembly 11, a leveling element 14 and a substrate support 30 for a substrate 33. In one example, the dispenser assembly 11 includes an array 16 of side-by-side dispensers 17 and an air pressure assembly 20. In one aspect, the dispensers 17 of array 16 extend generally parallel to each other in a generally planar configuration. In another aspect, the array 16 of dispensers 17 extend in a first orientation (represented by arrow A) generally transverse to a second orientation (represented by arrow B) and generally transverse to a substrate advance orientation C (which is parallel to the second orientation).

In some examples, relative movement between the dispenser assembly 11 and the substrate 33 is accomplished via the leveling element 14 and the dispenser assembly 11 moving, in unison, along the substrate advance orientation relative to a stationary substrate 30. In some examples, relative movement between the dispenser assembly 11 and the substrate 33 is accomplished via the substrate 33 being advanced (via substrate support 30) along the substrate advance orientation relative to a stationary leveling element 14 and stationary dispenser assembly 11. In either arrangement, relative movement (as represented by arrow C) between dispenser assembly 11 and substrate 33 occurs until substantially the entire substrate 33 has been scanned by the dispenser assembly 11 to deposit coating material on the entire substrate 33.

In one aspect, each dispenser 17 includes a first end portion 19A and an opposite second end portion 19B. In another aspect, the dispensers 17 each have generally the same length such that a tip of the second end portions 19B (of the array 16 of dispensers 17) together extend in a plane that is generally parallel to the leveling element 14. In one aspect, while FIG. 1A illustrates four dispensers 17, it will be understood that there can be fewer or greater than four dispensers.

In some examples, the leveling element 14 includes a member having at least a generally planar surface that is slidably engageable against the substrate to be coated. In one example, the member includes an elongate plate having a length generally the same as a width of the substrate.

In some examples, the leveling element 14 includes a generally cylindrical element, such as an elongate drawdown rod, as further described later in association with FIGS. 3A-3B and 4. It will be noted that the term "drawdown" does not necessarily dictate a direction in which the rod is actuated but refers to the process of making a volume of liquid more uniform at a thickness generally less than a thickness that the liquid initially exhibits when first deposited on the surface to be coated.

In one aspect, with this arrangement a coating liquid is dispensed generally at the same time from each dispenser 17 such that the coating liquid generally covers an entire width of the to-be-coated substrate 33, contributing to forming a coating having a uniform thickness across an entire surface of the substrate 33.

In one example, the air pressure assembly 20 includes an array 22 of conduits 24. In one aspect, a first end of each conduit 24 is connectable to and in fluid communication with the first end portion 19A of a respective one of the dispensers 17. Meanwhile, an opposite, second end of each conduit 24 is connectable to and in fluid communication with an air pressure source 21. Via this arrangement, a common air pressure is provided to the first end portion 19A of each dispenser 17. In some examples, an air pressure assembly 20 includes a manifold 33 to facilitate distribution of a common air pressure to all dispensers 17. However, it will be understood that in some examples, the manifold 33 is omitted and each dispenser 17 receives the common air pressure from its own conduit 24 routed directly to and from the air pressure source 21.

As further described later, air pressure assembly 20 provides a controlled air pressure that causes, when actuated, liquid to be dispensed from the passive dispensers 17 onto the substrate 33.

In some examples, the air pressure source 21 is located remotely from the dispensers 17, as shown in FIG. 1A.

The substrate support 30 includes a first end 37A and an opposite second end 37B and includes a first side 38A and an opposite second side 38B. In one aspect, the support 30 is sized and shaped to support the substrate 33, which includes a first end 35A and an opposite second end 35B.

In one aspect, the substrate 33 has a width W1 extending along the first orientation (directional arrow A) and a length L1 extending along the second orientation (directional arrow B). In some examples, the array 16 of dispensers 17 has a width that is generally the same as the width W1. In some examples, the leveling element 14 has a width generally the same as or greater than the width W1 of substrate 33.

In one example, the dispenser assembly 11 is positioned vertically above the substrate 19, as further illustrated later in association with at least FIGS. 3A-3B and 5.

In some examples, as shown in FIG. 1A, the leveling element 14 is generally spaced apart by a distance D1 from a second end portion 19B of the dispensers 17, which is further illustrated later in association with FIGS. 3A-3B.

Accordingly, in general terms, during relative movement between the dispenser assembly 11 and the substrate support 30, the leveling element 14 remains at a fixed distance (D1) relative to the array 16 of dispensers and in a position to slidably engage accumulated liquid on substrate 33 after deposition from the array 16 of dispensers 17. In one aspect, the gap defined by the distance D1 corresponds to an area in which a coating liquid dispensed by dispensers 17 accumulates on the substrate 33. Upon the occurrence of relative movement between the dispenser assembly 11 and the substrate 30, the leveling element 14 causes the dispensed coating liquid to be distributed in a uniform thickness across the entire width of the substrate 33, and along the length of the substrate, as further illustrated later in association with at least FIGS. 10A-10B.

In some examples, each dispenser 17 contains a volume of coating liquid that is independent of the volumes of coating liquid within the other respective dispensers 17. In one aspect, each dispenser 17 contains its volume of coating liquid independent of an external source of coating liquid. Accordingly, in this example, each dispenser 17 is filled with a fixed volume of coating liquid and upon consumption of that volume of coating liquid over a period of time (through coating multiple substrates via coating system 10), the dispenser 17 will be empty and need to be re-filled manually with coating liquid.

In general terms, the coating system 10 is equipped to apply ultra-thin coatings to a substrate, which can comprise any one of a wide variety of materials. In one aspect, the coating system is well suited to applying liquid coatings having a low viscosity.

In some examples, the substrate 33 comprises an organic photoconductor (OPC) of a digital printing press. Such coatings help to prevent microscratches in a surface of the photoconductor, whose presence would otherwise attract ink byproducts, which in turn, produce visible streaks in printing output. These visible streaks can become more noticeable with extended use of the photoconductor. However, applying an ultrathin polymeric coating on the photoconductor can help prevent such microscratches, which in turn minimizes the occurrence of the visible streaks. In some examples, such polymeric coatings can extend a lifetime of the photoconductor to be two to three times longer than the lifetime of an uncoated photoconductor. At least some examples of the present disclosure provide one coating system capable of applying such polymeric coatings to a photoconductor of a digital print press in a consistent, reproducible manner. Using the coating system, a large number of coated organic photoconductors can be produced with protective coatings that have a consistently reproducible uniform thickness.

In some examples, the organic photoconductor is formed on a Mylar sheet having a thickness of about 75 micrometers. In some examples, the organic photoconductor has a width of about 350 millimeters.

In some examples, the coating system 10 is well suited to uniformly applying a coating liquid that includes polymeric coating materials suspended within a low viscosity carrier. In some examples, during application the coating liquid has a thickness on the order of 10 micrometers and after drying, the resulting polymeric coating has a thickness about two orders of magnitude less than the thickness during application. In one example, the thickness of the coating after drying is about 100 nanometers. In some examples, the coating liquid comprising the polymeric material includes solid concentrations from 0.05 to 25 percent suspended within a volatile low viscosity liquid, such as alcohol. In one example, the viscosity is on the order of 1-2 milliPascal seconds (mPa s). With at least these parameters, in one example the desired coating thickness and uniformity is achieved via a traversal speed of the leveling element and dispensers of about 0.01 to about 0.1 m/second.

In some examples, applying such polymeric coatings can extend the useful life of the organic photoconductor several times the lifetime over the lifetime of an uncoated organic photoconductor.

In sharp contrast, traditional slot coating equipment does not provide enough control over such low viscosity liquids and such traditional slot coaters are better suited to providing coatings having a final, dried thickness on the order of about 10-100 micrometers, which is at least two to three orders of magnitude thicker than the final thickness coating (i.e. a thickness after drying) resulting from at least some examples of the present disclosure. In another aspect, traditional slot coaters are relatively expensive compared to the coating system in at least some examples of the present disclosure.

As shown in FIG. 1B, in some examples of the present disclosure, the dispenser assembly 11 forms part of a coating system 40 that includes a control module 50. In general terms, the control module 50 controls the relative movement between the dispenser assembly 11 and substrate support 30 (with substrate 33 thereon) and controls the timing, duration, etc. of application of air pressure to the dispensers 17 to cause the coating liquid to flow directly from each dispenser 17 onto substrate 33 in front of leveling element 14. Further aspects regarding the control module 50 are further described later in association with at least FIGS. 2A and 8-10B.

FIG. 2A is a block diagram of a coating system 70, according to one example of the present disclosure. As shown in FIG. 2A, coating system 70 includes a dispensing assembly 11, an air pressure assembly 74, a carriage assembly 76, a substrate transport assembly 78, and a control module 50. As previously described in association with FIGS. 1A-1B, dispenser assembly 11 includes an array 16 of dispensers 17 to deposit a coating liquid onto a substrate and is in a position for leveling element 14 to further establish a generally uniform layer, having a target thickness, of the coating liquid on the substrate 33.

Air pressure assembly 74 supplies pressurized air to dispenser assembly 11. In some examples, dispenser assembly 11 and at least some portions of air pressure assembly 74 are housed together in a single unit. In some examples, as shown in FIG. 1A, at least some portions (such as the air pressure source 21) of the air pressure assembly 74 are positioned remotely from the dispenser assembly 11, with the air pressure source 21 communicating air pressure to the dispensers 17 via at least the array 22 of air supply conduits 24.

In some examples, carriage assembly 76 moves dispenser assembly 11 relative to a stationary substrate support 30 (FIG. 1A) at generally the same time as the dispenser assembly 11 deposits coating liquid onto the substrate 33. In some examples, substrate transport assembly 78 moves substrate 33 relative to dispenser assembly 11 at generally the same time as the dispenser assembly 11 deposits coating liquid onto the substrate 33.

In another aspect, control module 50 communicates with dispenser assembly 11, media transport assembly 78, and, in one example, carriage assembly 76. It will be understood that via its communication with dispense assembly 11, control module 20 also communicates with air pressure assembly 74.

In one example, control module 50 provides control of dispenser assembly 11 including timing control for pressurized flow of a coating material from the dispenser assembly 11 onto substrate 33. While the dispenser assembly 11, in cooperation with leveling element 14 (FIG. 1A), generally deposits coating liquid to cover an entire width of the substrate 33, the dispenser assembly 11 need not continually dispense the coating liquid to cover an entire length of the substrate 33. Moreover, as further described later, in some instances such as a startup period, the dispenser assembly 11 will deposit coating liquid onto the substrate 33 prior to relative movement between the dispenser assembly 11 and the substrate 33. In addition, in some instances such as near the end of a coating run on a substrate, the dispenser assembly 11 terminates depositing coating liquid while relative movement still occurs between the dispenser assembly 11 and the substrate 33 with the leveling element 14 spreading the remaining volume of coating liquid (on the substrate 33) over the remaining surface of the substrate 33.

Timing control and, therefore, the schedule of dispensing coating liquid is determined by coating job commands and/or command parameters provided via control module 50. In one example, at least some portions of logic and drive circuitry that forms a portion of control module 50 is located on dispenser assembly 11, air pressure assembly 74, carriage assembly 76, and/or substrate transport assembly 78. In another example, at least some portions of such logic and drive circuitry is located remotely from the respective dispenser assembly 11, air pressure assembly 74, carriage assembly 76, and/or substrate transport assembly 78.

As shown in FIG. 2B, in some examples the coating system 70 (FIG. 2A) further includes a liquid supply assembly 90 to supply the coating liquid to the dispenser assembly 11. In some examples, liquid supply assembly 90 is in communication with each dispenser 17 and equipped to refill or continually supply the dispensers 17 with a supply of coating liquid.

Figure 4:
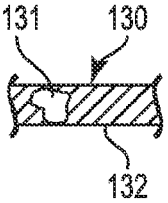
FIG. 4 is an enlarged partial view of a leveling element, according to one example of the present disclosure.

FIG. 3A is a diagram including a side view schematically illustrating a coating system 100 including a dispenser assembly 111, according to one example of the present disclosure. In one example, the coating system 100 (including dispenser assembly 111) comprises at least some of substantially the same features and attributes as coating system 10, 70, as previously described in association with at least FIGS. 1A-2A.

As shown in FIG. 3A, dispenser 117 is representative of a full array of dispensers (like array 16 of dispensers 17 in FIG. 1A) and is in a dispensing mode such that dispenser 117 is oriented at an angle (represented by $\alpha 1$) to dispense coating liquid (represented by Q) from second end portion 1198 of dispenser 117 onto substrate 133. In particular, a longitudinal axis (represented by line X) of dispenser 117 forms an angle α1 relative to a plane S through which the substrate 133 (or substrate support 30 in FIG. 1A) extends.

In one example, the end portion 1198 of dispenser 117 is spaced apart vertically above the substrate 133 by a distance (T1). In some examples, the distance is selectively variable depending on the thickness of the coating liquid on substrate 133. In some examples, the distance (T1) is selected to maintain a thickness of pooled coating liquid (Q) that is at least equal to and/or greater than the distance T1.

In some examples, in the dispensing mode, the representative dispenser 117 extends at angle α1 of about 50 to 90 degrees. In some examples, the angle α1 is between about 60 and 85 degrees. In some examples, the angle α1 is about 80 degrees. In one aspect, using these angles that are at least greater than 50 degrees enables the dispensed liquid to spread laterally across the substrate 133 before engagement with the leveling element 114. In sharp contrast, using too low of an angle (e.g. below 50 degrees, depending on the viscosity, travel speed, etc.) prevents a phenomenon of liquid momentum in which some of the force by which the dispensed liquid was dispensed unnecessarily causes the dispensed liquid to have a velocity when engaged by the leveling element 114 and thereby interferes with the ability of the leveling element 114 to uniformize the coating liquid. In some instances, such liquid momentum can result in a liquid build up on the opposite side of the leveling element 114 in which the intended uniform coating is no longer uniform and/or thicker than intended. Accordingly, the dispensing mode utilizes angles greater than 50 degrees to avoid such behaviors and phenomenon.

Figure 3B:
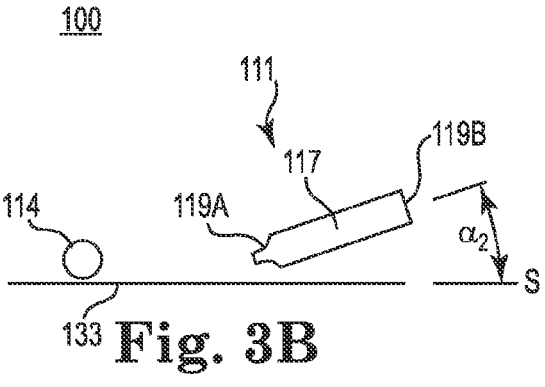
FIG. 3B is a diagram including a side view of schematically illustrating a dispenser assembly in an idle mode, according to one example of the present disclosure.

FIG. 3B is a diagram including a side view of coating system 100 like the diagram in FIG. 3A, except illustrating the representative dispenser 117 in an idle mode in which coating liquid is not dispensed from dispenser assembly 111. In one example, the idle mode is used between coating runs and/or during a storage/maintenance period. As shown in FIG. 3B, a longitudinal axis of dispenser 117 is oriented at an angle of about 20 degrees relative to a plane S. In some examples, the angle α2 is between about 10 to 30 degrees. In some examples, the angle α2 is between about 15 to about 25 degrees. In one aspect, these smaller angles (15 to 25 degrees) prevent dripping of coating liquid from dispensers 117 without involving traditional back pressure systems.

FIG. 4A is a plan view of a portion of a leveling element 130, according to one example of the present disclosure. As shown in FIG. 4A, in one example, leveling element 130 comprises a draw down element, which includes an elongate, generally cylindrical element 131, such as a rod, and a wire 132 that is wound continuously about an outer surface or periphery of, and along a length of, the generally cylindrical element 131. In one aspect, the winding 132 facilitates passage of controlled volumes of coating liquid through the small gaps between the adjacent portions 136 of winding 132.

Figure 5:
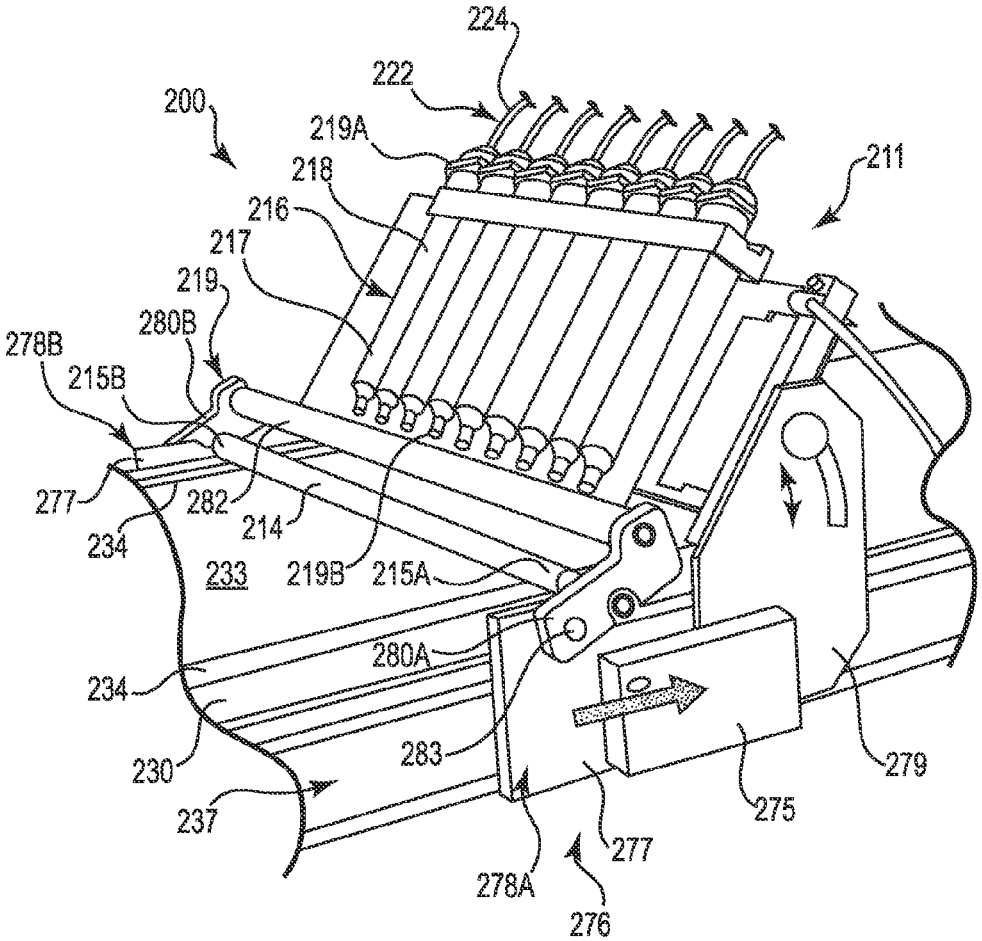
FIG. 5 is a perspective view of a coating system, according to one example of the present disclosure.

FIG. 5 is a perspective view of a coating system 200, according to one example of the present disclosure. In one example, coating system 200 includes at least some of substantially the same features and attributes of coating systems 10, 20, 110 as previously described in association with FIGS. 1A-4.

As shown in FIG. 5, coating system 200 includes a dispensing assembly 211 and a leveling element 214 positioned over a substrate 233 on a substrate support 230. The dispenser assembly 211 and leveling element 214 are supported by a carriage assembly 276 that is slidably movable relative to, and along a length of a frame 237 of the substrate support 230. The carriage assembly 276 includes a first side portion 278A and on an opposite side of the substrate support, a second side portion 278B. Each side portion 278A, 278B includes a base portion 275, a first portion 277, and a second portion 279.

In one aspect, the respective first portions 277 (of the opposite side portions 278A, 278B) extends vertically upward from the base portion 275 and to support opposite ends 215A, 215B of the leveling element 214 (such as a drawdown rod) and thereby position the leveling element 214 above and generally transverse to substrate 233. In one example, the leveling element 214 forms a part of a leveling assembly 219, which includes two opposite arms 280A, 280*b* that are pivotally mounted relative to an upper end portion of the first portion 277. In one aspect, the leveling element 214 includes a second elongate element 282 to augment, via gravitational forces, pressing (slidable) contact of the leveling element 214 against the substrate 233. In one example, the second elongate element 282 has a weight substantially greater than a weight of the leveling element 214 and is spaced apart from the leveling element 214. In some examples, the weight of the second element is sufficient to create a contact pressure of about $2\times10^4$ to about $6\times10^4$ N/m2.

In some examples, the substrate support 230 comprises a generally rigid member (e.g. glass) and further includes a resilient, compliant member 234 (such as a foam material) overlying the generally rigid member. The resilient, compliant member 234 receives the substrate 233 and is provided to yieldingly receive the weighted leveling assembly 219, which ensures firm releasable engagement of leveling element 214 against the substrate 233 in a generally uniform manner. In one example, the resilient, compliant member has a thickness of about six millimeters. With this arrangement, sliding relative movement between the leveling element 214 (and the dispenser assembly) and the substrate 233 will result in the leveling element 214 making uniform the coating liquid dispensed by dispenser assembly 211 as the liquid is channeled in a controlled manner underneath leveling element 214.

Via a pivot point 283, the entire leveling assembly 219 is rotationally positionable in an engagement position, as shown in FIG. 3A, or in a non-engaging position in which the leveling assembly 215 is rotated away from the substrate 233 such that leveling element 214 is not in contact against the substrate 233.

As further shown in FIG. 5, for each side portion 278A, 278B, the second portion 279 extends vertically upward from the base portion 275 on opposite sides of the substrate support 430 and supports an array 216 of dispensers 217 across a width of substrate support 430. Like the earlier example shown in FIGS. 3A-3B, the dispenser assembly 211 is movable between a dispensing mode (FIG. 3A) and a storage mode (FIG. 3B). As shown in FIG. 5, the dispenser assembly 211 is in a dispensing mode so that a second end portion 219B of each dispenser 217 is positioned above and adjacent substrate 233. Meanwhile, a first end portion 219A of each dispenser 117 is connected to an air supply conduit 224 of an array 222 of conduits 224, which in turn is in fluid communication with an air pressure source (e.g. air pressure source 21) to provide a common air pressure to each dispenser 217.

In some examples, as shown in FIG. 5, each dispenser 217 comprises a syringe having a barrel-shaped portion 218 and a nozzle end portion at least partially defining second end portion 219B of each dispenser 117. In some examples, at least some of the syringes are replaceable and/or disposable.

In some examples, as shown in FIG. 5, the array 216 of dispensers 217 includes nine syringes uniformly spaced apart with each syringe having a width of about 36 millimeters such that the second end portion 19B or liquid outlet (e.g. needle, nozzle, etc.) of the syringes are spaced apart by about 36 millimeters.

Figure 6:
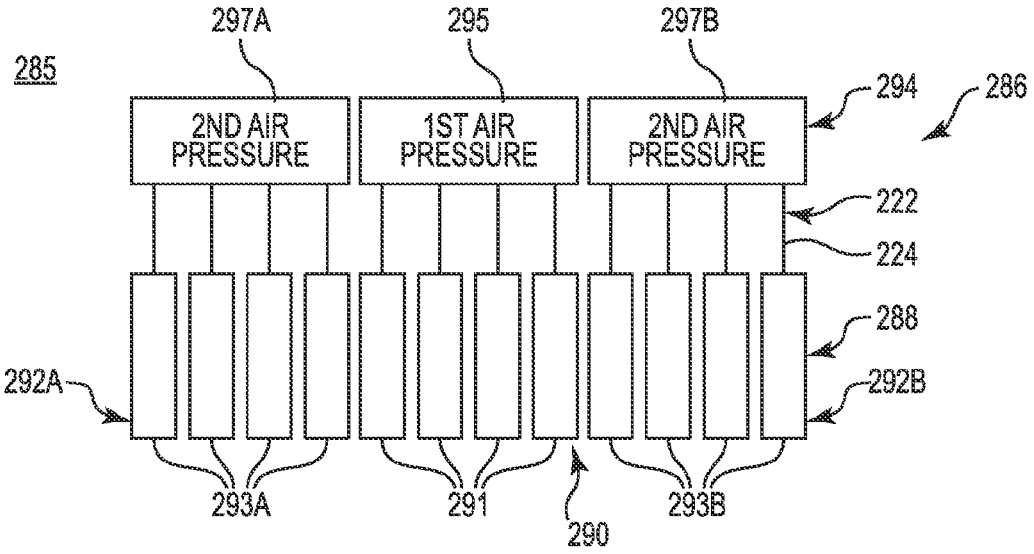
FIG. 6 is a top plan view schematically illustrating an assembly including an array of dispensers and an air pressure assembly including at least two different air pressure portions, according to one example of the present disclosure.

FIG. 6 is a diagram 285 of at least a portion of a coating system 286, according to one example of the present disclosure. In some examples, coating system 286 includes at least some of substantially the same features and attributes as coating system 10, 20, 110, 200 as previous described and illustrated in association with at least FIGS. 1A-5.

As shown in FIG. 6, in some examples, coating system 286 includes an array 288 of side-by-side dispensers with each dispenser holding its own volume of coating liquid independent from the volume of coating liquid in the other respective dispensers. In one example, the array 288 includes a central group 290 of dispensers 291 and two outer groups 292A, 292B of dispensers 293A, 293B (respectively) located on opposite sides of, and laterally outward from, the central group 290.

In addition, as further shown in FIG. 6, coating system 286 includes an air pressure assembly 294 including a first air pressure portion 295 and two outer second air pressure portions 297A, 297B. In some examples, the air pressure portions 295, 297A, 297B are in fluid communication, via array 222 of conduits 224, with an air pressure source.

In one aspect, via a control module, the first air pressure portion 295 applies a first air pressure to each dispenser 291 in the central group 290 and the second air pressure portions 297A, 297B apply a second air pressure (different than the first air pressure) to the dispensers 293A, 293B in the second group 292A, 292B. In some examples, the second air pressure is substantially less than the first air pressure, so that a relatively lesser amount of coating liquid is dispensed in the outer regions than in the central region. This helps to prevent overcollection of coating liquid along outer lateral portions of a substrate.

Alternatively, in some examples, instead of the second air pressure portions 297A, 297B applying a lesser pressure, at a desired point in time at which it is believed that excess coating liquid is present at the outer edges of the substrate, the second air pressure portions 297A, 297B can be at least temporarily deactivated so that dispensing from the outer groups 292A, 292B of dispensers is suspended. In some examples, this suspension lasts the remaining duration of the coating run. In some examples, the suspension is temporary and after a period of time, the second air pressure portions 297A, 297B are reactivated to resume dispensing liquid from the outer groups 292A, 292B of dispensers.

Figure 7:
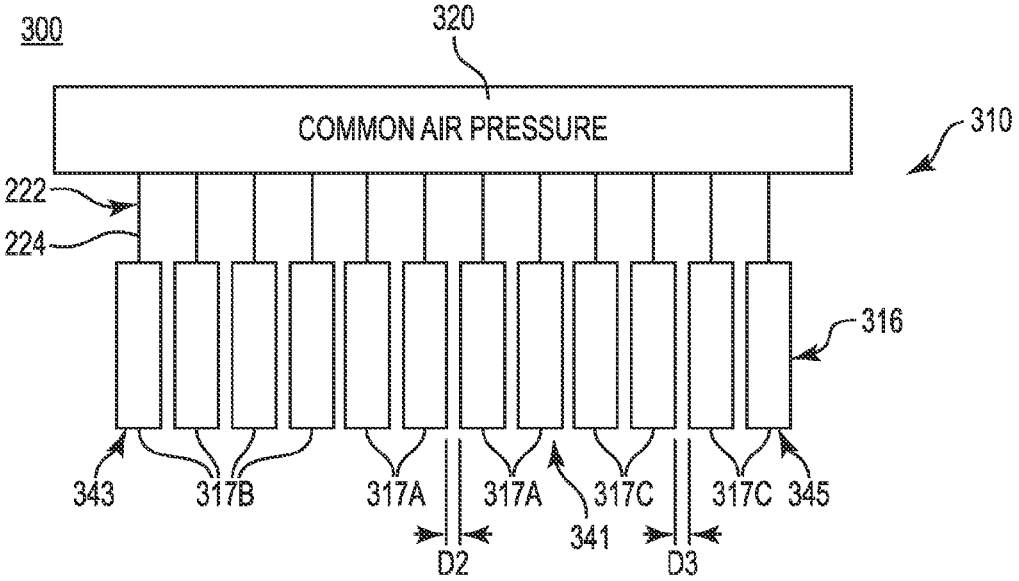
FIG. 7 is a top plan view schematically illustrating an assembly including an array of dispensers having differently spaced groupings of dispensers, according to one example of the present disclosure.

FIG. 7 is a diagram 300 of at least a portion of a coating system 310, according to one example of the present disclosure. In some examples, coating system 310 includes at least some of substantially the same features and attributes as coating system 10, 20, 110, 200 as previous described and illustrated in association with at least FIGS. 1A-5.

As shown in FIG. 7, in some examples, coating system 310 includes an array 316 of side-by-side dispensers with each dispenser holding its own volume of coating liquid independent from the volume of coating liquid in the other respective dispensers. In one example, the array 316 includes a central group 341 of dispensers 317A and two outer portions 343, 345 of dispensers 317B, 317C located laterally outward from, and on opposite sides of, the central group 341. As shown in FIG. 7, the dispensers 317A in the central group 341 are uniformly spaced apart from each other by a first distance (D2) while the dispensers 317B, 317C in the outer groups 343, 345 are spaced apart from each other by a second distance (D3) that is greater than the first distance D2. Accordingly, the dispenser assembly of coating system 310 has a greater density (in a lateral orientation generally transverse to a substrate advance direction) of dispensers in a central portion than in the laterally outward outer portions of the dispenser assembly.

In some examples, instead of the spacing (D2, D3) between the respective dispensers in the two outer groups 343, 345 being uniform, the spacing can vary and continually increase (on a dispenser-by-dispenser basis) in a direction away from the central portion of the array 316. In this arrangement, the spacing between dispensers 317A is closer in the central portion of array 316 and increases in distance in opposite directions extending outward from the central portion. In some examples, the distance (D1) between adjacent dispensers in the central group 341 is uniform. In some examples, the distance between adjacent dispensers across the whole array 316 varies by increasing (on a dispenser-by-dispenser basis) in a direction outward from a dispenser (or pair of dispensers) that are centrally located within the array 316.

In addition, as further shown in FIG. 7, coating system 310 includes an air pressure assembly 320 that applies a common air pressure, via array 22 of conduits 224 to the dispensers of array 316.

With reference to at least the examples shown in FIGS. 6 and 7, in some examples, with these arrangements, a relatively lesser amount of coating liquid is dispensed in the laterally outward outer regions of the substrate than in central regions of the substrate. This helps to prevent overcollection of coating liquid along outer lateral portions of a substrate. Of course, it will be understood that as relative movement occurs between the dispenser assembly and the substrate, the leveling element will spread the pooled coating liquid on the substrate so that the coating liquid is applied in a generally uniform layer over and across both a width and length of the substrate. With this in mind, the systems shown in FIGS. 6 and 7 facilitate providing a uniform coating without unnecessarily wasting coating liquid by overdispensing coating liquid in the laterally outward regions of the substrate.

In some examples, the varied spacing between adjacent dispensers along the length of the array (FIG. 7) is combined with differential air pressure control (FIG. 6) to further increase the degree of control over the volume and/or rate of liquid dispensed at the outer edges of the substrate relative to the center portions of the substrate.

Figure 8:
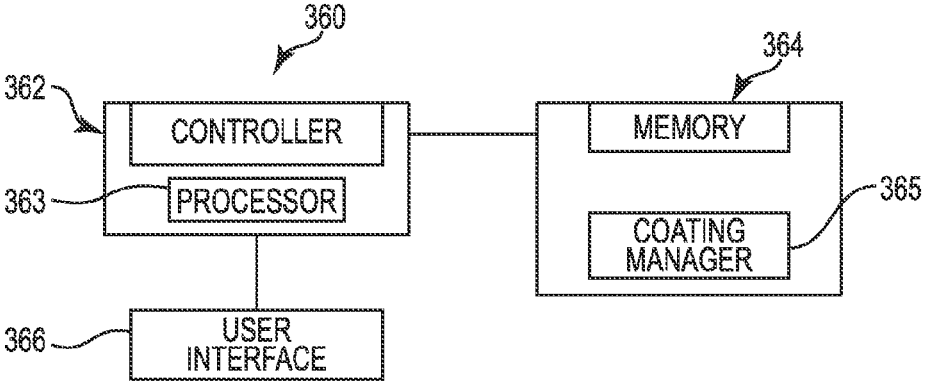
FIG. 8 is a block diagram schematically illustrating a control portion of a coating system, according to one example of the present disclosure.

FIG. 8 is a block diagram schematically illustrating a control portion 360 of a coating system, according to one example of the present disclosure. As shown in FIG. 8, control portion 360 includes at least some of substantially the same features and attributes as control module 50, as previously described in association with at least FIGS. 1B, 2A. In some examples, control portion 360 includes a controller 362, a memory 364, and a user interface 366.

In general terms, controller 362 of control portion 360 comprises at least one processor 363 and associated memories that are in communication with memory 364 to generate control signals directing operation of at least some components of the systems and components previously described in association with at least FIGS. 1-7. In some examples, these generated control signals include, but are not limited to, directing operation of a coating system, including dispensing coating liquid from an array of dispensers during relative movement between the dispensers and a substrate. In particular, in response to or based upon commands received via a user interface 366 and/or machine readable instructions (including software), controller 362 generates control signals to direct operation of a coating system 10, 20, 200, 286, 310, etc. and in accordance with at least some of the previously described examples and/or later described examples of the present disclosure. In one example, controller 362 is embodied in a general purpose computer and communicates with a coating system while in other examples, controller 362 is incorporated within the coating system.

For purposes of this application, in reference to the controller 362, the term "processor" shall mean a presently developed or future developed processor (or processing resources) that executes sequences of machine readable instructions (such as but not limited to software) contained in a memory. Execution of the sequences of machine readable instructions, such as those provided via control module 50, memory 364 of control portion 360 and/or coating manager 370 (FIG. 9) causes the processor to perform actions, such as operating controller 362 to form a coating layer in a manner generally described in at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium, as represented by memory 364. In one example, memory 364 comprises a computer readable tangible medium providing non-volatile storage of the machine readable instructions executable by a process of controller 362. In other examples, hard wired circuitry may be used in place of or in combination with machine readable instructions (including software) to implement the functions described. For example, controller 362 may be embodied as part of at least one application-specific integrated circuit (ASIC). In at least some examples, the controller 362 is not limited to any specific combination of hardware circuitry and machine readable instructions (including software), nor limited to any particular source for the machine readable instructions executed by the controller 362. In some examples, user interface 366 comprises a user interface or other display that provides for the simultaneous display, activation, and/or operation of at least some of the various components, functions, features, and of control module 20, control portion 360, and coating manager 370 as described in association with at least FIGS. 1A-8C. In some examples, at least some portions or aspects of the user interface 366 are provided via a graphical user interface (GUI).

Moreover, it will be understood that the features, functions, modules, and components of the control module 50, control portion 360, and coating manager 370 as described throughout the disclosure can be arranged in different forms and groupings, and therefore the control module 20, control portion 360, and coating manager 370 (FIG. 9) are not strictly limited to the particular arrangement or groupings of functions, modules, and components illustrated in FIGS. 1A-9.

Figure 9:
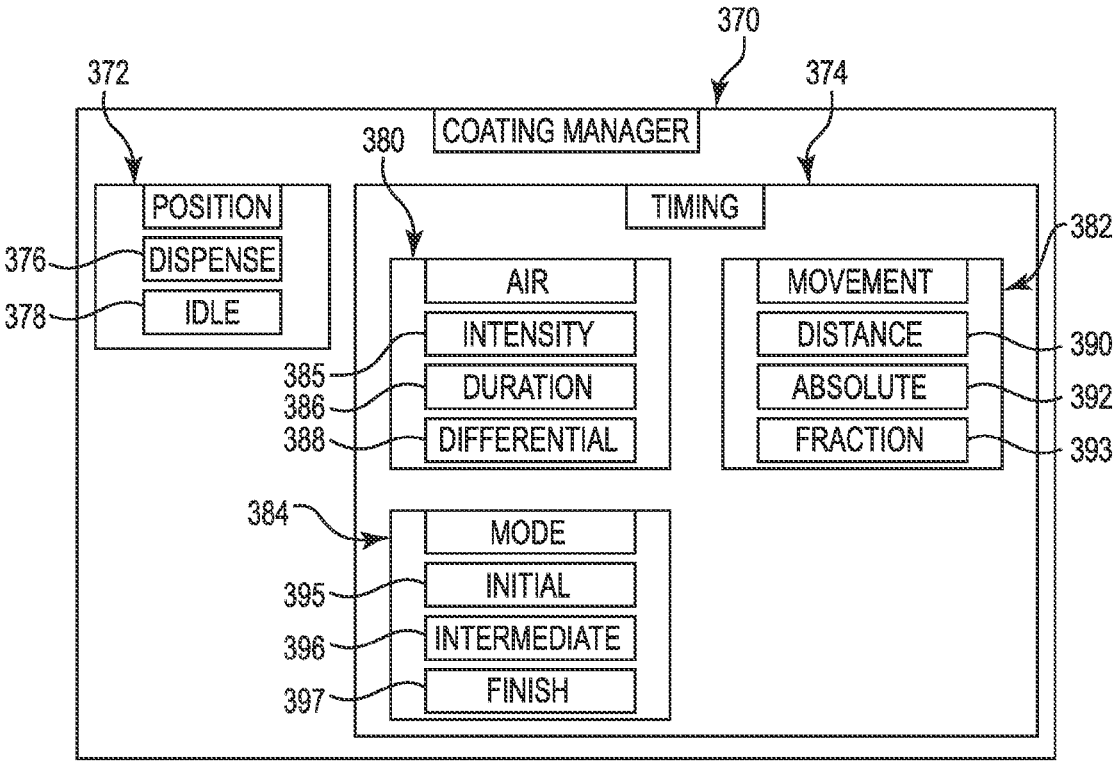
FIG. 9 is a block diagram schematically illustrating a coating manager, associated with a memory, according to one example of the present disclosure.

FIG. 9 is a block diagram schematically illustrating a coating manager 365, according to one example of the present disclosure, storable in memory 364 as previously illustrated in association with FIG. 8. As shown in FIG. 9, in one example the coating manager 370 comprises a position module 372 and a timing control module 374. In general terms, the position module 372 tracks a status of, and/or controls, a selectively rotatable position of the dispenser assembly. In some examples, the position module 372 includes a dispense mode 376 and an idle mode 378 wherein the dispense mode 376 corresponds to a dispenser assembly (e.g. dispenser assembly 111 in FIG. 3A) being in a dispensing orientation, such as shown in FIG. 3A in which the dispensers 117 are at a relatively steep angle between about 50 to about 90 degrees of a generally horizontal plane (S in FIG. 3A). Meanwhile, the idle mode 378 corresponds to a dispenser assembly (e.g. dispenser assembly 111 in FIG. 3A) being in an idle orientation, such as shown in FIG. 3BA in which the dispensers 117 are at a relatively shallow angle between about 15 to about 25 degrees of a generally horizontal plane (S in FIG. 3A) to prevent dripping of coating liquid from an end of the dispensers 117.

In some examples, as shown in FIG. 9, the timing control module 374 comprises an air module 380, a movement module 382, and a mode module 384. In general terms, the air module 380 at least partially controls the manner in which air pressure is applied to the dispensers 117 to cause controlled dispensing of coating liquid from the dispensers onto the substrate.

In one aspect, the air module 380 includes an intensity parameter 385, duration parameter 386, and a differential parameter 388. In one aspect, the intensity parameter 385 tracks a status of, and/or controls, an intensity or amplitude of air pressure applied to the dispensers of the dispenser assembly while the duration parameter 386 tracks the status of, and/or controls, a duration for which a given air pressure is applied. The differential parameter 388 tracks the status of, and/or controls, different air pressures applied to different dispensers of a dispenser assembly. For example, differential parameter 388 is engaged to track the status of, and/or control, the different pressures applied in at least some of the previously described examples associated with FIG. 6.

In general terms, the movement module 382 tracks a status of, and/or controls, relative movement between a substrate and a dispenser assembly. In some examples, the movement module 382 comprises a distance parameter 390, an absolute position parameter 392, and a fraction parameter 394. The distance parameter 390 tracks a status of, and/or controls, a distance by which the dispenser assembly 111 and the substrate 33 have moved relative to each other, which in turn is indicative of the extent to which the substrate 33 has been coated.

In one aspect, the absolute parameter 392 tracks a status of, and/or controls, an absolute position of a dispenser assembly relative to a length of a substrate. This absolute parameter 392 ensures initiating, maintaining, and/or terminating dispensing functions via dispenser assembly based on an absolute position of the components of the coating system.

In another aspect, the fraction parameter 393 ensures initiating, maintaining, and/or terminating dispensing functions via dispenser assembly based on a fraction (e.g. a percentage) of a total amount of relative movement (between a dispenser assembly and a substrate) along a length of the substrate that would take place to completely coat the substrate.

Additional parameters associated with the movement module 382 are further described later in association with FIGS. 10A-10B.

With further reference to FIG. 9, in general terms mode module 384 tracks a status of, and/or controls, modes of relative movement between the dispenser assembly and the substrate during a coating run. For example, the mode module 384 includes an initial mode 395, an intermediate mode 396, and a finish mode 397. In the initial mode 395, the dispenser assembly dispenses coating liquid onto the substrate without any relative movement between the dispenser assembly and the substrate. In one aspect, this initial mode ensures that an adequate pool of coating liquid accumulates on the substrate before timing module 374 permits relative movement between the dispenser assembly and the substrate. Accordingly, this arrangement ensures coverage of the coating liquid over the entire width of the substrate at beginning portions of a coating run and a sufficient volume to achieve uniformity in the coating.

In the intermediate mode 396, a dispenser assembly causes dispensing of coating liquid onto the substrate, while at generally the same time, relative movement is occurring between the dispenser assembly and the substrate. In one aspect, this mode generally is engaged between the opposite ends of the substrate to be coated.

In the finish mode 397, a dispenser assembly terminates dispensing of coating liquid onto the substrate, while at generally the same time, relative movement continues between the dispenser assembly and the substrate. In one aspect, this mode generally is engaged near the end of a coating run to ensure that an excessive amount of coating liquid is not wasted because the ongoing pool of coating liquid (due to the generally continuous dispensing of coating liquid) in front of the leveling element is generally adequate to finishing coating of the substrate. In some examples, the finish mode is enacted after about ninety percent of a length of a substrate has been coated, as will be further illustrated in association with FIG. 10B. In some examples, the finish mode is enacted sooner or later than ninety percent of a length of the substrate has been coated.

Figure 10A:
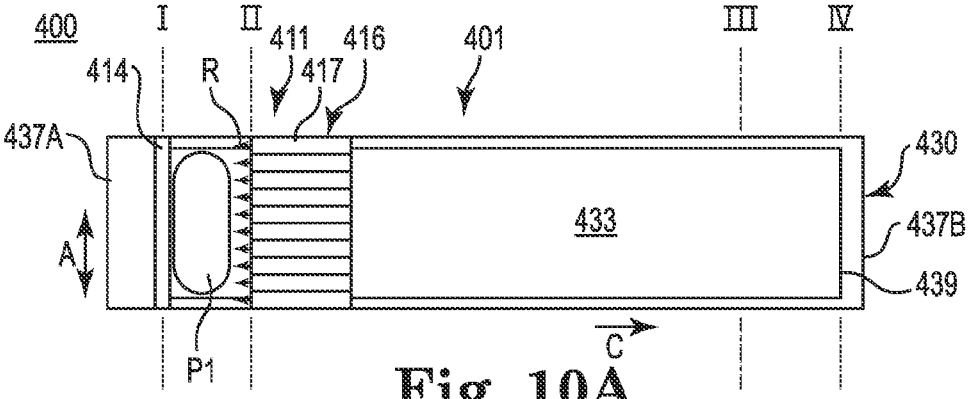
FIG. 10A is a diagram including a top plan view schematically illustrating a coating system operating in an initial mode, according to one example of the present disclosure.

FIG. 10A is a diagram 400 including a top plan view of a coating system 401, according to one example of the present disclosure. In one example, the coating system 401 includes at least some of the substantially the same features and attributes as the coating systems 10, 22, 100, 200, as previously described and illustrated in association with FIGS. 1A-9. Accordingly, FIG. 10A employs like reference numerals to refer to like elements. As shown in FIG. 10A, the coating system includes an array 416 of side-by-side dispensers 417 and a leveling element 414 spaced apart from the array 416. As shown in FIG. 10A, the dispenser assembly is in an initial or starting position, such as described in association with initial mode 395 of mode module 384 (of timing module 374) of coating manager 370 in FIG. 9. As such, a pool P1 has begun accumulating on substrate 433 prior to commencing relative movement between the substrate 433 and the array 416 of dispensers 417. In another aspect, this initial starting position is further represented by the reference indicator (I) where the leveling element 414 is generally aligned with a first end of the substrate 433 to be coated. Meanwhile, indicator (II) represents the starting position at which dispensers 417 dispense coating liquid (represented by arrows R) onto the substrate 433 to create the pool P1 and from which relative movement will occur between dispensers 417 and the substrate 433 once the coating run commences.

Figure 10B:
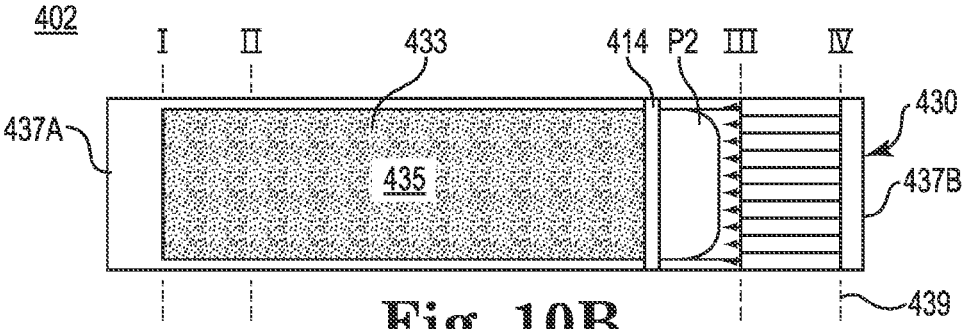
FIG. 10B is a diagram including a top plan view schematically illustrating a coating system operating in a finish mode, according to one example of the present disclosure.

FIG. 10B is a diagram 402 including a top plan view of a coating system 401, according to one example of the present disclosure. In one example, the coating system 401 includes at least some of the substantially the same features and attributes as the coating system 401 shown in FIG. 10A, except with the dispenser assembly (including dispensers 417 and leveling element 414) and the substrate 433 being in a different position relative to the each other because the coating run has been substantially completed.

Accordingly, as shown in FIG. 10B, the dispenser assembly is in a finishing position, such as described in association with finish mode 395 of mode module 384 (of timing module 374) of coating manager 370 (FIG. 9). As such, this finishing position is represented by the reference indicator (IV) which identifies that a portion of the array of dispensers 417 is in close proximity to a second end 437B of the substrate support 430 and generally aligned with an opposite second end 439 of the substrate 433 to be coated. Meanwhile, indicator (III) represents the point at which dispensing of the coating liquid (from dispensers 417) is terminated because the pool P2 of coating liquid on substrate 430 is sufficient to complete coating substrate 433 without further dispensing of coating liquid. In one example, the indicator III is located at a point about ninety percent of a length (L1 in FIG. 1A) of the substrate to be coated. In one aspect, FIG. 10B schematically illustrates the presence of a uniform coating 435 on substrate 433 as a result of the previously occurring relative movement between the dispenser assembly 411 and the substrate 433.

Figure 11:
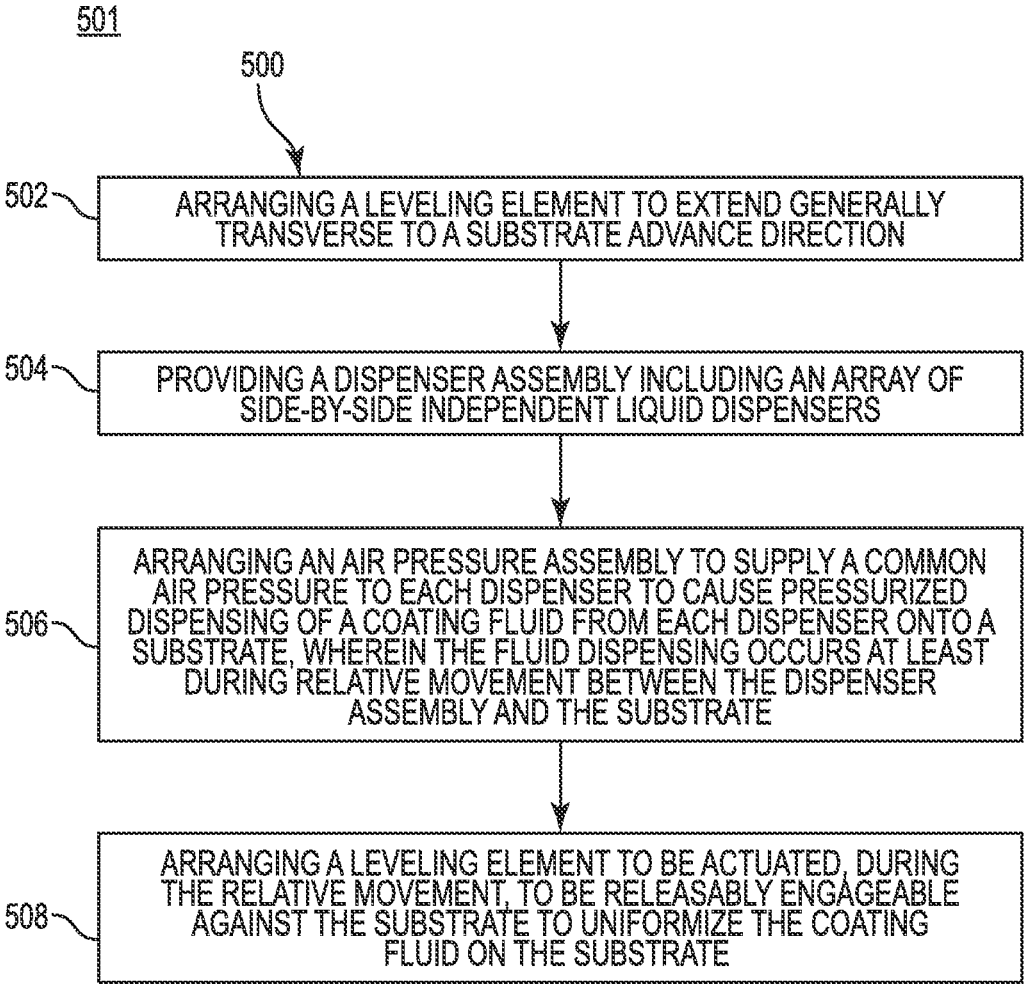
FIG. 11 is a flow diagram schematically illustrating a method of manufacturing a coating system, according to one example of the present disclosure.

FIG. 11 is a flow diagram 501 schematically illustrating a method 500 of manufacturing a coating system, according to one example of the present disclosure. In some examples, method 500 is performed using at least substantially the same systems, assemblies, components, modules, and/or elements as previously described in association with FIGS. 1A-10B. In some examples, method 500 is performed using systems, assemblies, components, modules, and/or elements other than those previously described in association with FIGS. 1A-10B.

In one example, as shown in FIG. 11, method 500 includes arranging a leveling element to extend generally transverse to a substrate advance orientation. At 504, method 500 includes providing a dispenser assembly including an array of side-by-side independent liquid dispensers with the array being spaced apart from the leveling element along the substrate advance orientation. At 506, method 500 includes arranging an air pressure assembly to supply a common air pressure to each dispenser to cause pressurized dispensing of a coating liquid from each dispenser onto a substrate on the substrate support. In one aspect, the liquid dispensing occurs at least during relative movement between the dispenser assembly and the substrate support. At 508, method 500 includes arranging a leveling element to be actuated, during the relative movement, into releasable engageable against the substrate (on the substrate support) to uniformize the coating liquid on the substrate.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A coating system comprising:

a leveling element extending generally transverse to a substrate advance orientation and releasably engageable against a substrate support;

a dispenser assembly including:

an array of independent liquid dispensers, wherein each dispenser operates independent of, and separate from, an external liquid source at least during liquid dispensing, wherein the respective dispensers extend side-by-side generally transverse to the substrate advance orientation and across substantially an entire width of the substrate support, wherein the dispenser assembly includes:

a first group of the respective side-by-side independent dispensers being centrally located within the array and uniformly spaced apart from each other by a first distance, and two second groups of the respective side-by-side independent dispensers with the second groups being located on opposite sides of, and spaced laterally outward from, the first group, wherein each second group is spaced apart from the first group in an orientation transverse to the substrate advance orientation, and an air pressure assembly to supply a common air pressure to a first end portion of each dispenser to cause pressurized dispensing of a coating liquid from an opposite, second end portion of each dispenser onto a substrate on the substrate support, wherein the air pressure assembly is separate from, and independent of, the external liquid source, and wherein, during operation of the system for coating, the liquid dispensing occurs at least during relative movement between the dispenser assembly and the substrate support, and during the relative movement, the leveling element is actuated to uniformize the coating liquid on the substrate.

2. The coating system of claim 1, wherein the leveling element and the dispensers move in unison during such relative movement.

3. The coating system of claim 1, wherein the leveling element extends across substantially an entire width of the substrate support.

4. The coating system of claim 3, wherein the coating liquid has a viscosity on the order of one milliPascal seconds (mPA s).

5. The coating system of claim 4, wherein the substrate comprises an organic photoconductor and wherein the coating liquid, after deposit on the substrate, has a thickness before drying on the order of 10 micrometers and a thickness after drying about two orders of magnitude less than the thickness before drying.

6. The coating system of claim 3, wherein the substrate support includes a resilient, compliant member to receive the substrate thereon.

7. The coating system of 1, wherein the dispensers within each second group are spaced apart from each other by distances greater than the first distance.

8. The coating system of claim 1, wherein the air pressure assembly comprises:

a first control portion to control a first air pressure to the first group of dispensers; and a second control portion to control, independent of the first control portion, a second air pressure to the second group of dispensers.

9. The coating system of claim 1, wherein the air pressure assembly includes:

an air pressure source to provide the common air pressure; and a plurality of air supply conduits coupled to the air pressure source with each respective air supply conduit coupled to, and in fluid communication with, a respective one of the dispensers at the first end portion of each dispenser.

10. The coating system of claim 1, wherein the dispensers are positionable at:

a first angle of greater than 50 degrees relative to the substrate support to dispense liquid in front of the leveling element, at least during relative movement between the dispenser assembly and the substrate support; and a second angle of less than 25 degrees relative to the substrate support when the coating system in an idle mode.

11. The coating system of claim 10, wherein the first angle is between about 60 to about 85 degrees relative to the substrate support and the second angle is about 20 degrees.

12. The coating system of claim 1, wherein the leveling element comprises an elongate rod including a wire wound about an outer surface of the rod and generally extending a length of the rod.

13. The coating system of claim 1, comprising:

a control module includes an initiation mode to dispense the coating liquid, prior to initiation of the relative movement, from the dispensers across substantially the entire width of the substrate to cause accumulation of the coating liquid between the leveling element and the dispensers, wherein such initiation occurs up to dispensing a one third of the total volume to be dispensed.

14. The coating system of claim 13, wherein the control module comprises:

a finish mode to terminate dispensing of the coating liquid upon the array of dispensers being positioned, during the relative movement, at a location prior to an opposite, second end of the substrate.

* * * * *